US006765138B1

(12) United States Patent
Fast et al.

(10) Patent No.: US 6,765,138 B1
(45) Date of Patent: Jul. 20, 2004

(54) REGISTER SYSTEM FOR CONTRABASSOON

(75) Inventors: Arlen Fast, Teaneck, NJ (US); Thomas J. Owen, Jr., Columbia City, IN (US)

(73) Assignee: Fox Products Corporation, South Whitley, IN (US)

( * ) Notice: Subject to any disclaimer, the term of this patent is extended or adjusted under 35 U.S.C. 154(b) by 36 days.

(21) Appl. No.: 10/272,365

(22) Filed: Oct. 16, 2002

Related U.S. Application Data

(60) Provisional application No. 60/329,922, filed on Oct. 17, 2001.

(51) Int. Cl.[7] ..... G10D 7/00

(52) U.S. Cl. ..... 84/380 R; 84/381; 84/385 R; 84/386; 84/395; 84/396

(58) Field of Search ..... 84/380 R, 381, 84/385 R, 386, 395, 396

(56) References Cited

U.S. PATENT DOCUMENTS

| | | | | | |
|---|---|---|---|---|---|
| 2,504,547 | A | * | 4/1950 | Edward | 84/385 R |
| 3,127,806 | A | | 4/1964 | Fox | |
| 3,202,031 | A | * | 8/1965 | Polisi | 84/380 R |
| 3,438,298 | A | * | 4/1969 | Thompson | 84/380 C |
| 4,376,403 | A | | 3/1983 | Haedrich et al. | |
| 4,442,750 | A | | 4/1984 | Bowley | |
| 4,714,001 | A | | 12/1987 | Kergomard et al. | |
| 5,044,248 | A | | 9/1991 | Kenmochi | |
| 6,078,002 | A | | 6/2000 | Kenmochi | |

* cited by examiner

*Primary Examiner*—Shih-Yung Hsieh
(74) *Attorney, Agent, or Firm*—Barnes & Thornburg

(57) ABSTRACT

A contrabassoon has a body, a tuning slide, a bocal pipe and a novel register system. The body, tuning slide and bocal pipe form a tube having a continuous bore. The register system comprises 5 vent holes formed in the tube. Key mechanisms for selectively opening and closing the vent holes are described. The contrabassoon further comprises linkage to selectively operate a low E vent pad, and an alternative C-sharp tone hole, with accompanying key mechanism.

27 Claims, 10 Drawing Sheets

REGISTER SYSTEM FOR CONTRABASSOON

RELATED APPLICATION

This application is based upon U.S. Provisional Application Serial No. 60/329,922, filed on Oct. 17, 2001, the complete disclosure of which is hereby expressly incorporated herein by this reference thereto.

FIELD OF INVENTION

The present invention relates generally to musical instruments and, specifically, to contrabassoons. More particularly, the present invention relates to a novel register system for a contrabassoon.

BACKGROUND AND SUMMARY OF THE INVENTION

The modem contrabassoon was developed by Wilhelm Heckel of Biebrich, Germany, in 1879. While there have been numerous refinements and mechanical improvements to the Heckel system contrabassoon, the fundamental acoustics have remained basically constant since that time.

With respect to the register, or vent system, the earliest Heckel contrabassoons used two vent holes operated simultaneously by a single key. At some time, probably within a decade before or after 1900, a second vent key was introduced in an attempt to simplify the fingerings and the performance of higher range notes. Since that time, the acoustics of the vent system have not significantly changed. Vent hole sizes and locations have changed only in very small amounts.

Performers on the contrabassoon are accustomed to the difficulties of playing the notes that require the use of the register keys. The difficulties of obtaining a clear attack of notes with good intonation have been accepted as normal.

A preferred embodiment of the present invention includes a number of new features which represent significant advances in contrabassoon design and function. These features include:

a. a new register system, comprising 5 vent holes selectively operated by three newly developed key mechanisms;

b. a redesigned linkage from the lower register key touchpiece for the left thumb to the low E key (943); and c. a new alternate C# key for the right hand second finger (RH2).

This system will provide the contrabassoon player with certain playing options and capabilities which were previously impossible, or at best difficult, to achieve.

One embodiment of the present invention is a contrabassoon having a body, a tuning slide coupled to the body, and a bocal pipe coupled to the tuning slide. The body, tuning slide and bocal pipe form a tube having a continuous bore extending therethrough. The embodiment further includes a register system comprising 5 vent holes formed in the tube. The preferred embodiment of the invention further comprises a key mechanism for selectively opening and closing the vent holes.

In one embodiment of the invention, at least 1 of the 5 vent holes is formed in the bocal pipe. In a preferred embodiment, 4 of the 5 vent holes are formed in the bocal pipe. In this embodiment, one of the 5 vent holes is formed in the tuning slide.

In one embodiment, the first of the 5 vent holes is located approximately 1 inch from an end of the bore (i.e., approximately 1 inch from the bocal end of the bocal pipe). The first hole is approximately 0.083 inch in diameter.

In one embodiment, a second of the 5 holes is located approximately 9⅛ inches from an end of the bore. The second hole is approximately 0.099 inch in diameter.

In one embodiment, a third of the 5 holes is located approximately 12⅛ inches from an end of the bore. The third hole is approximately 0.110 inch in diameter.

In one embodiment, a fourth of the 5 holes is located approximately 17½ inches from an end of the bore. The fourth hole is approximately 0.110 inch in diameter.

In one embodiment, a fifth of the 5 holes is located approximately 22 15/16 inches from an end of the bore. The fifth hole is approximately 0.126 inch in diameter. In a preferred embodiment, the fifth hole is located in the tuning slide. In this embodiment, the distance from the end of the bore to the fifth vent hole will vary with the position of the tuning slide.

In one embodiment of the present invention, a portion of the key mechanism for selectively opening and closing the vent holes is configured to selectively open a first and a second of the 5 vent holes. This portion of the key mechanism preferably comprises a touchpiece configured for actuation by the left thumb.

In one embodiment of the invention, a portion of the key mechanism for selectively opening and closing the vent holes is configured to selectively open a third one of the vent holes. This portion of the key mechanism preferably comprises at least 2 touchpieces configured for alternative actuation by the left thumb or the right trigger finger.

In one embodiment of the invention, a portion of the key mechanism for selectively opening and closing the vent pieces is configured to selectively open a fourth and fifth of the vent holes. This portion of the key mechanism preferably comprises a touchpiece configured for actuation by the left thumb. This portion of the key mechanism preferably further comprises linkage configured to selectively operate a low E vent pad. This linkage preferably comprises a clutch mechanism.

In one embodiment of the present invention, an alternatives C# tone hole is provided, along with a key mechanism for selectively opening and closing the alternative C# tone hole. This key mechanism preferably comprises a touchpiece configured for actuation by a finger of the right hand.

In a preferred embodiment of the invention, the register system is designed for optimum performance with the tuning slide pulled out approximately ½ inch.

The five holes of the new system provide the player with the following playing characteristics:

a clean attacks on all second and third octave notes at any dynamic level;

b. better stability of tone through crescendos and decrescendos on the second and third octave notes;

c. improved intonation over the upper two octaves;

d. simplified and more logical fingerings;

e. an expanded range of notes for the normal scale without special adaptations of the instrument or of the reeds to get them;

f. a more rounded and open tone for the upper register notes; and g. a greater number of good optional fingerings for smoother technique.

Other advantages and novel features of the present invention will become apparent from the following detailed description of the invention when considered in conjunction with the accompanying drawings.

DETAILED DESCRIPTION

A new system of five vent holes on a contrabassoon replaces the old system of vent holes. In the embodiment illustrated and described, the five new holes are generally larger than previous contrabassoon vent holes by any manufacturer.

Figure 1:
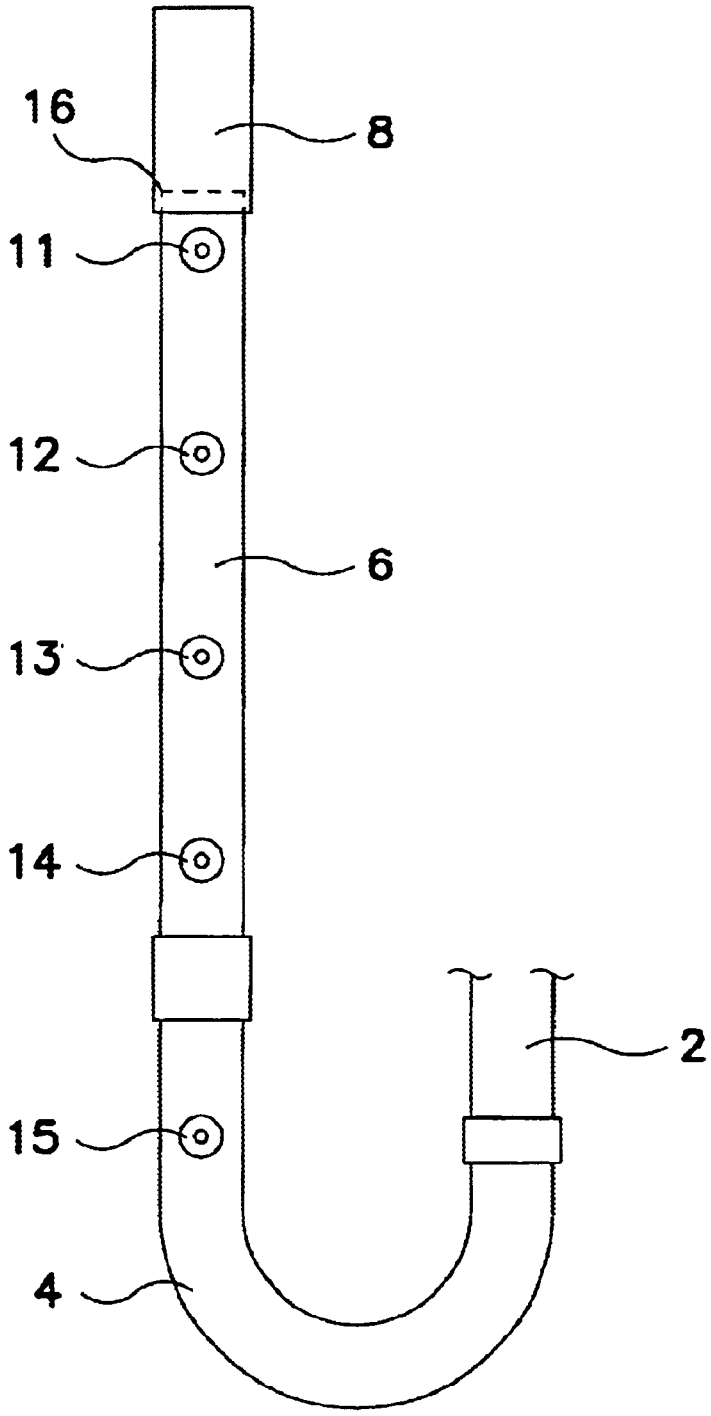
FIG. 1 shows a schematic view of a portion of one embodiment of a contrabassoon constructed in accordance with the present invention.

FIG. 1 shows, in representative form, a schematic view of a portion of one embodiment of a contrabassoon constructed in accordance with the present invention. The contrabassoon includes a body 2, a tuning slide 4, a bocal pipe 6 and a bocal socket 8. As is well known, body 2 typically comprises a long tubular structure made, for example, from wood. Tuning slide 4 is typically formed of metal plated with nickel and/or silver. Tuning slide 4 connects to the proximal end of body 2 and is used to adjust the pitch of the instrument by lengthening (or shortening) the tubular passage through which air is blown by a musician. Attached to a proximal end of tuning slide 4 is bocal pipe 6, an upright portion which, in turn, is connected to bocal socket 8. Bocal socket 8 receives a bocal (not shown) which is fitted with a double reed (not shown).

The five vent holes which form one aspect of the present invention are illustratively shown in FIG. 1 and identified by reference numerals 11, 12, 13, 14, and 15. In the embodiment shown, holes 11–14 are formed in bocal pipe 6, while vent hole 15 is formed in tuning slide 4. In a preferred embodiment of the present invention, vent hole 11 is located approximately 1 inch from a proximal end 16 of the continuous bore formed by bocal pipe 6, tuning slide 4 and body 2. The approximate diameter of vent hole 11 is 0.083 inch. Vent hole 12 is located approximately 9⅛ inches from end 16 of the bore, and is approximately 0.099 inch in diameter. Vent hole 13 is located approximately 12⅛ inches from end 16 of the bore, and is approximately 0.110 inch in diameter. Vent hole 14 is located approximately 17½ inches from end 16 of the bore, and is approximately 0.110 inch in diameter. Finally, vent hole 15 is located approximately 22 15/16 inches from end 16 of the bore, and is approximately 0.126 in diameter.

As illustrated in FIG. 1, vent hole 15 is located in the tuning slide portion of the instrument. Thus, the distance of vent hole 15 from end 16 of the bore will vary with the position of the tuning slide. In the preferred embodiment of the present invention, the register system is designed for optimum performance with the tuning slide pulled out approximately ½ inch. The tuning slide can be adjusted inwardly or outwardly from this point to cause the pitch of the instrument to increase or decrease, respectively.

Figure 2:
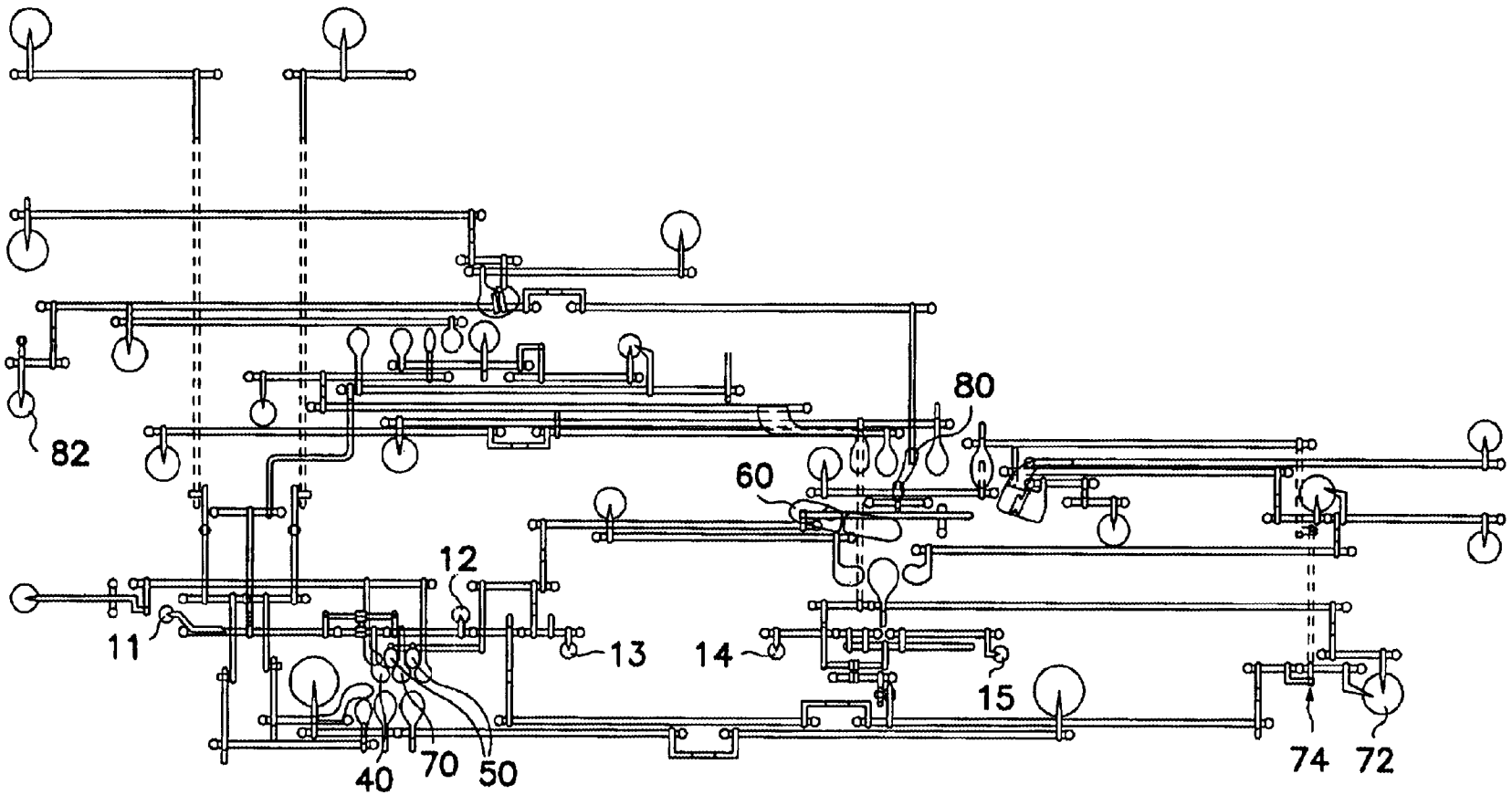
FIG. 2 shows a schematic view of the key mechanisms of one embodiment of a contrabassoon constructed in accordance with the present invention.

FIG. 2 shows a schematic view of the key mechanisms of one embodiment of a contrabassoon constructed in accordance with the present invention. The portions of the mechanism associated with the new features are shown in bold in FIG. 2. The new vent holes are identified by reference numerals 11 (vent 1), 12 (vent 2), 13 (vent 3), 14 (vent 4), and 15 (vent 5) in FIG. 2.

Figure 3A:
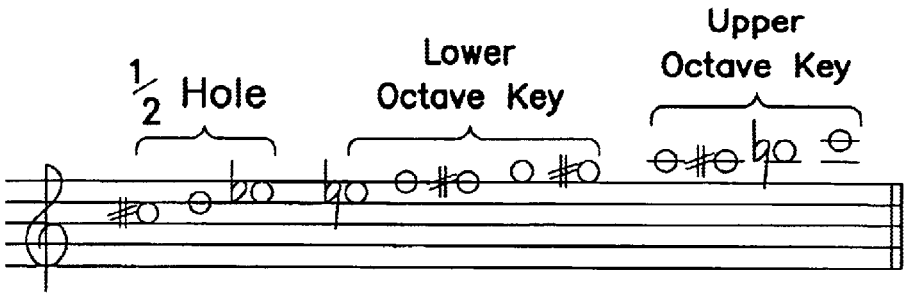
FIG. 3*a* illustrates register key usage for an oboe/English horn.
Figure 3B:
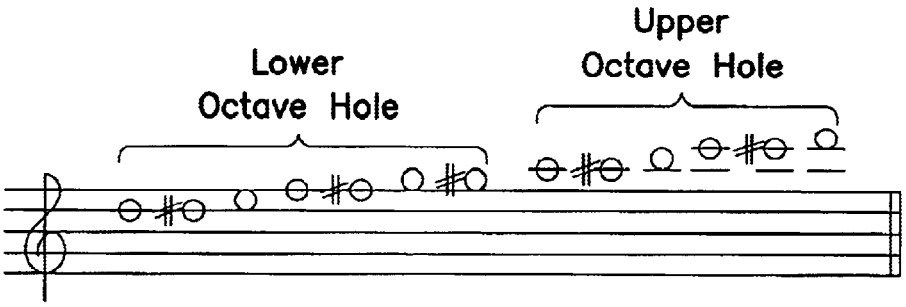
FIG. 3*b* illustrates register key usage for a saxophone.
Figure 3C:
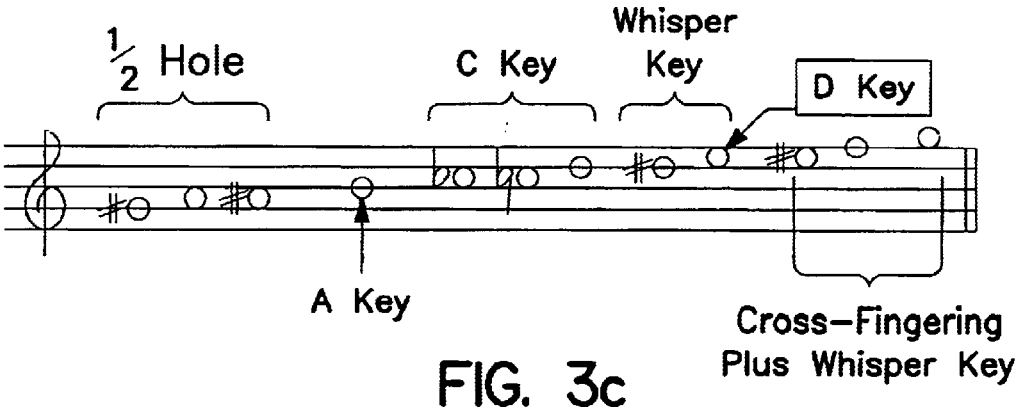
FIG. 3*c* illustrates register key usage for a bassoon.

By acoustical theory, each note of the scale of the fundamental octave should have its own register key. This would make a theoretically perfect, but physically unplayable, instrument. The solution for woodwind instruments is to provide only a few register keys and make them each serve a series of notes. FIGS. 3*a*, 3*b* and 3*c* illustrate register key usage for several conical bore woodwinds (oboe/English horn, saxophone, and bassoon, respectively). In the design of a new register key system for the contrabassoon, one of the big questions that had to be answered was, "How many notes can each hole serve?"

The inventors have observed that the behavior of vent holes on the bassoon shows that when a register hole is made large to provide clean and secure attacks at all dynamics on a row of more than three notes, the intonation on the lower notes becomes too sharp. On the other hand, when a register hole is made small in order to provide good intonation for a row of more than three notes, clean attacks, especially at loud dynamics on the lower notes of the row, become difficult. In addition, the issue of clean attacks is dynamics-dependent, with loud attacks demanding larger holes than soft attacks. Since the instrument must be able to provide clean note beginnings at all dynamics, the holes must be made large enough to provide this. These observations provided the foundation of understanding for designing the present new register key system for the contrabassoon.

A balance is struck in sizing the holes to provide both clean and secure attacks, while maintaining good, musically usable intonation. Because these principles work in opposition to each other, each hole should only serve a limited number of notes.

Additionally, register holes on a contrabassoon serve not only a second octave, but also a third octave and some notes beyond that. These high notes need the same good response and intonation qualities.

Figure 4:
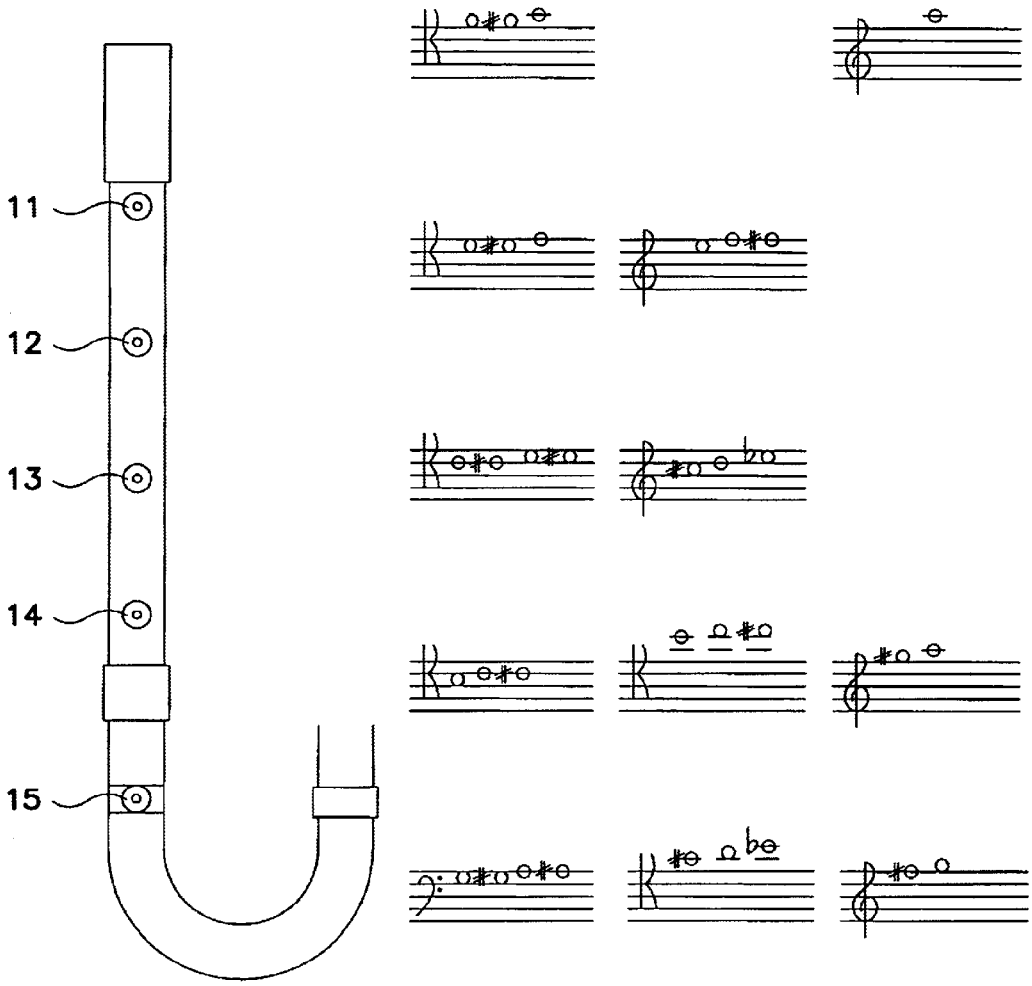
FIG. 4 illustrates the five vent holes on the bocal pipe of a contrabassoon constructed in accordance with the present invention, and the notes each hole serves.

FIG. 4 illustratively shows holes 11, 12, 13, 14, and 15 on the bocal pipe and tuning slide of a contrabassoon of the present invention, and the notes they serve. The five holes are located and sized to achieve a balance between clean, secure attacks and good intonation for the entire range of the upper register of the contrabassoon. The holes are not in a perfectly regular spacing from each other, nor do they have a regular progression of hole sizes. The fact that they must serve multiple registers of notes dictates this asymmetry.

Figure 5A:
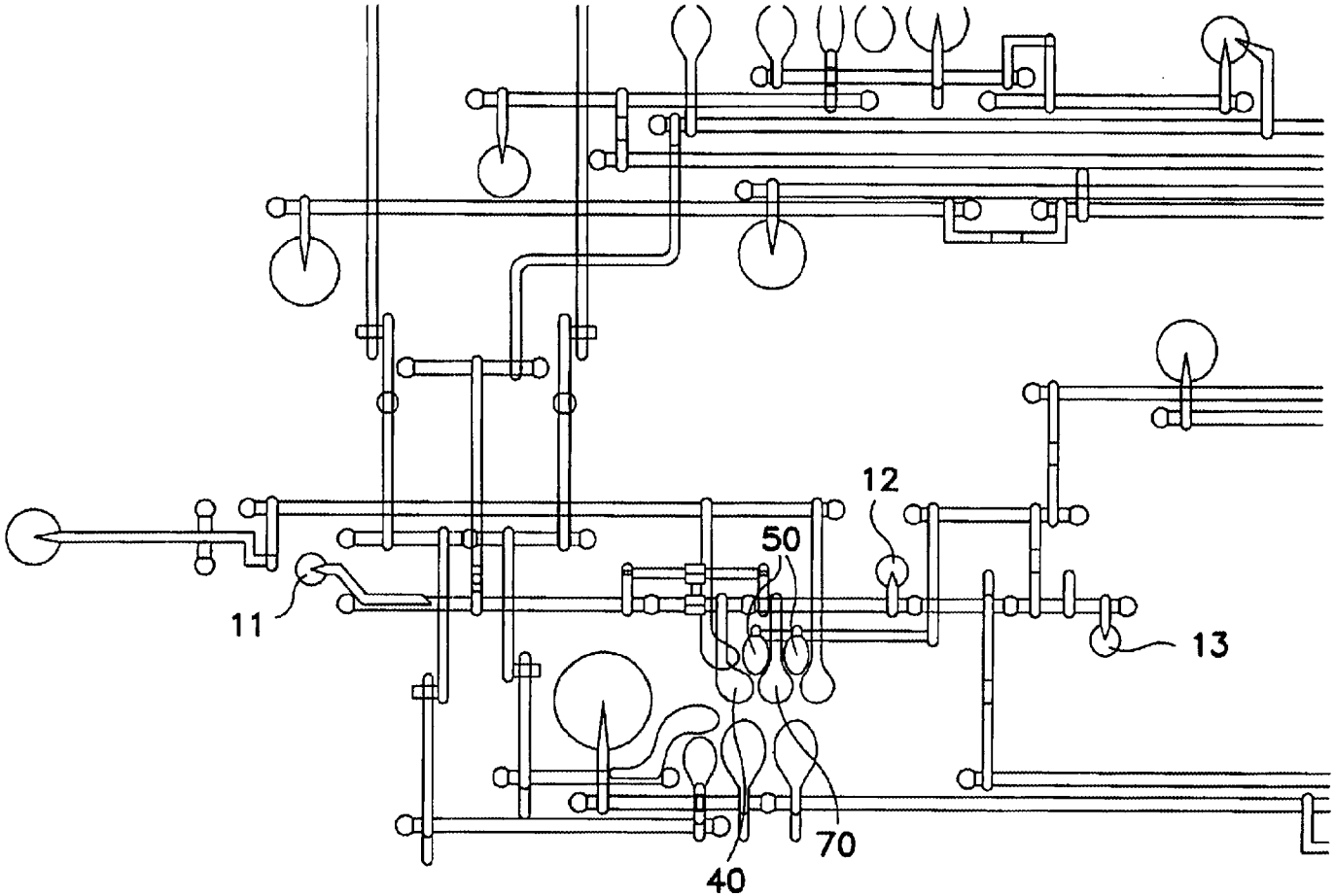
FIG 5*a* shows, in bold, key mechanisms associated with two of the five vent holes.

For these five holes, there are three separate key mechanisms, each having their own touchpieces. FIG. 5*a* shows, in bold, an upper vent automatic system, with a touchpiece 40 for the left thumb. The mechanism of this system acts on the two uppermost holes 11 and 12 of the five vents. When the left thumb depresses the upper vent key, one or the other of the two upper vents is opened, depending on whether the trigger finger, which is LH 1, is up or down.

Figure 5B:
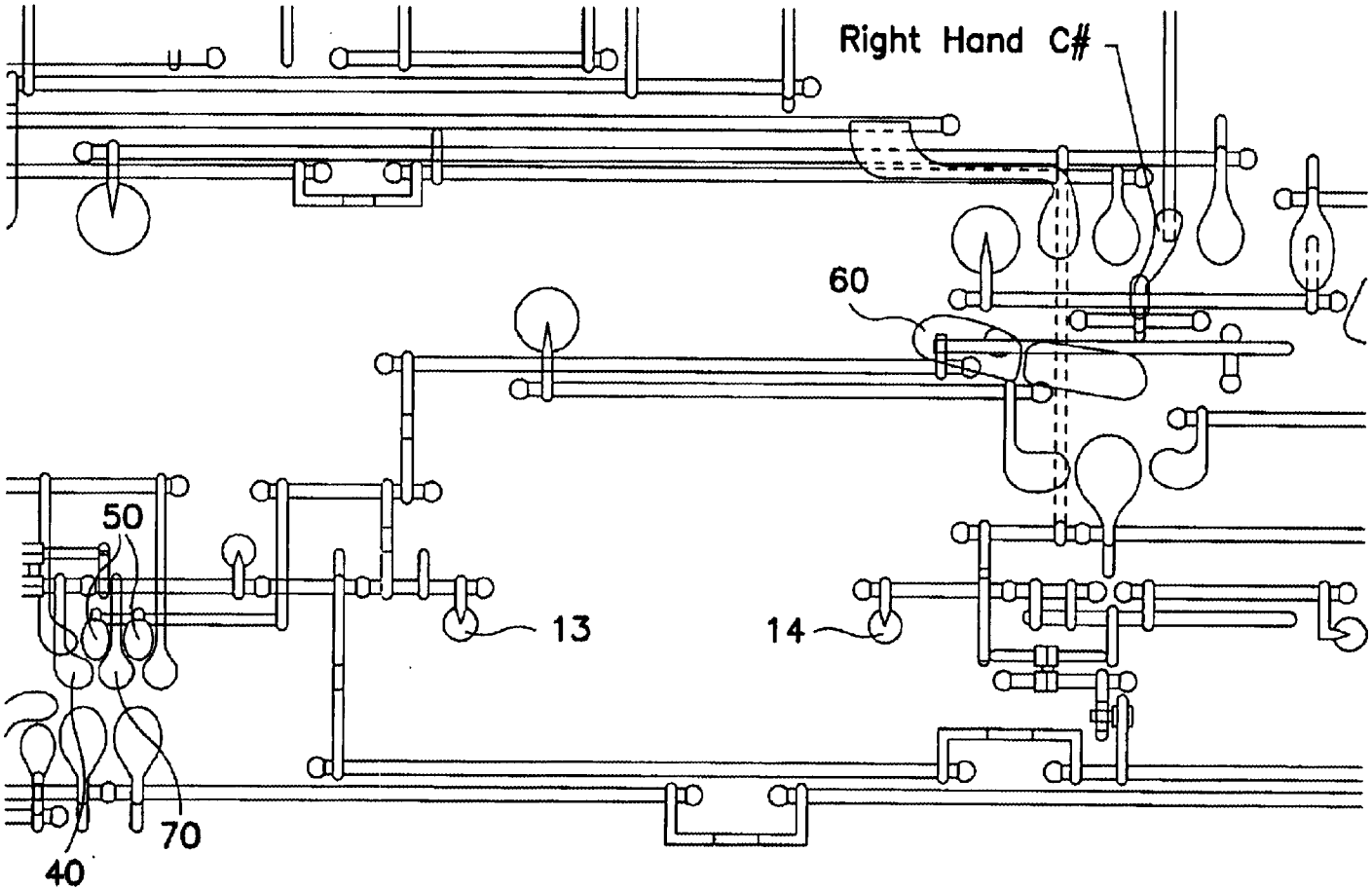
FIG. 5*b* shows key mechanisms associated with another of the five vent holes.

FIG 5*b* shows, in bold, alternate "D vent" spatulas 50 which open hole 13 of the five vents. This key mechanism has two activating points: one for the left thumb, which itself has touchpieces in two different locations, and one for the right hand, which is called a side key 60, and is activated by the side of the first finger of the right hand.

Figure 5C:
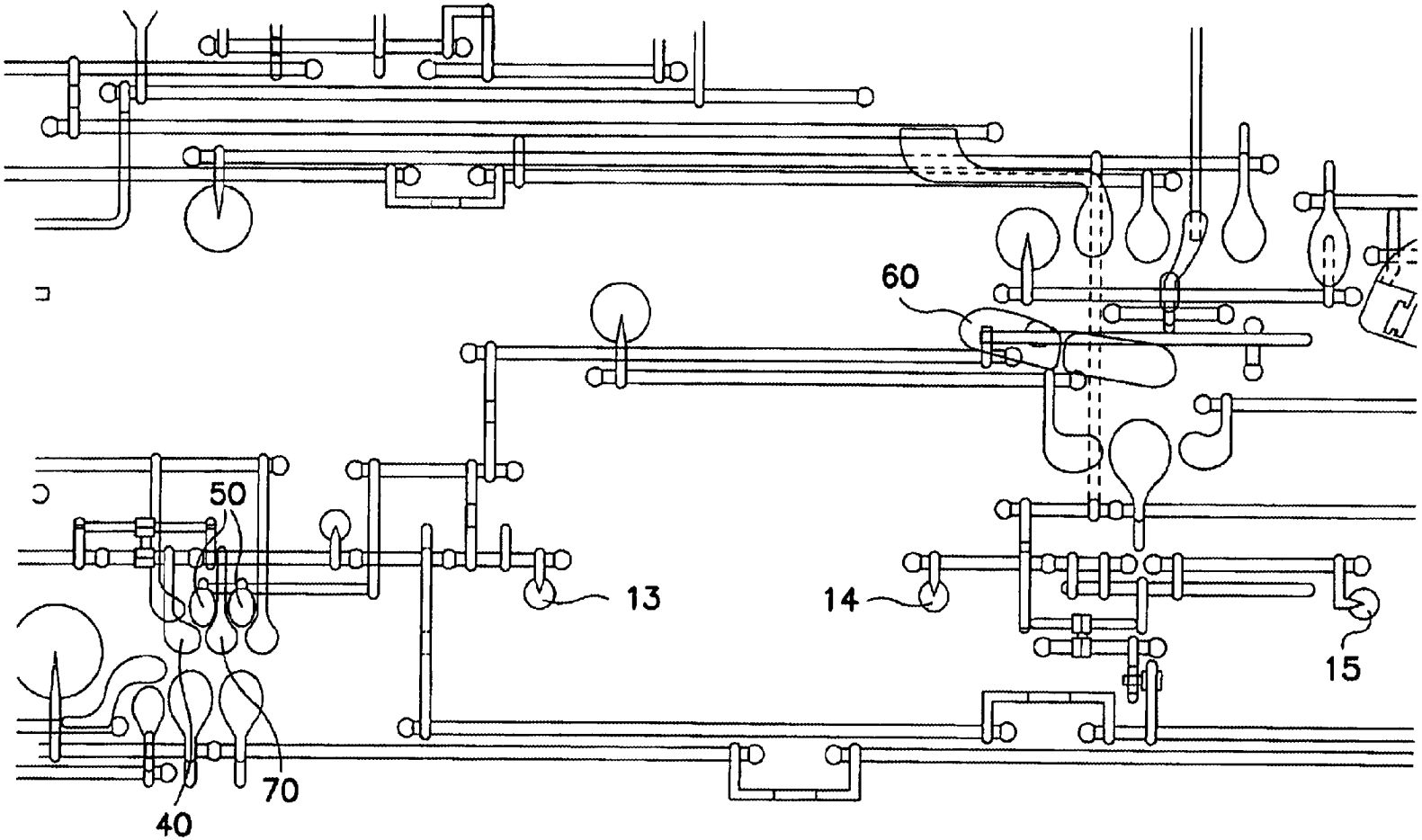
FIG. 5*c* shows key mechanisms associated with the remaining two of the five vent holes.

FIG. 5*c* shows a lower vent automatic system having a touchpiece 70 for the left thumb. The mechanism of this system acts on the two lower holes 14 and 15. When the left thumb depresses touchpiece 70, one or the other of the two lower vents is opened, depending on whether the trigger finger, RH 2, is up or down.

Figure 6:
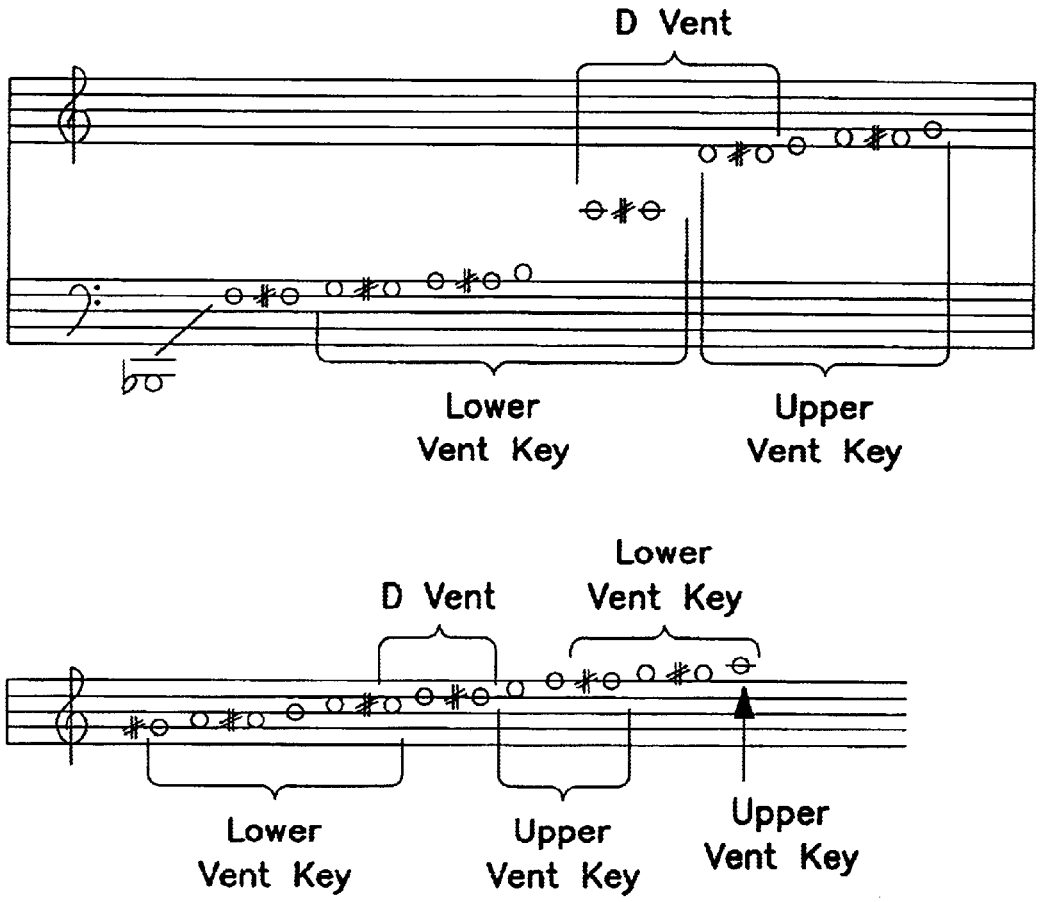
FIG. 6 shows the notes of the scale in the upper register of the contrabassoon, and which of the register keys may be used to play them.

These three mechanisms operate the five holes of the system. The holes open one at a time, depending on the note desired. Several notes may be played with one or the other of two different register keys, depending on how the player desires to execute a particular passage, but in any case, they are opened one at a time. This is a change from the former register key system, which had two pads covering separate vent holes near the tuning slide which opened in tandem (both at the same time). This former system does not always provide clean attacks at loud dynamics, nor does it always provide secure attacks on certain notes at soft dynamics. FIG. 6 shows the notes of the scale in the upper register of the contrabassoon, and which register key touchpiece(s) may be used to play them.

Figure 7:
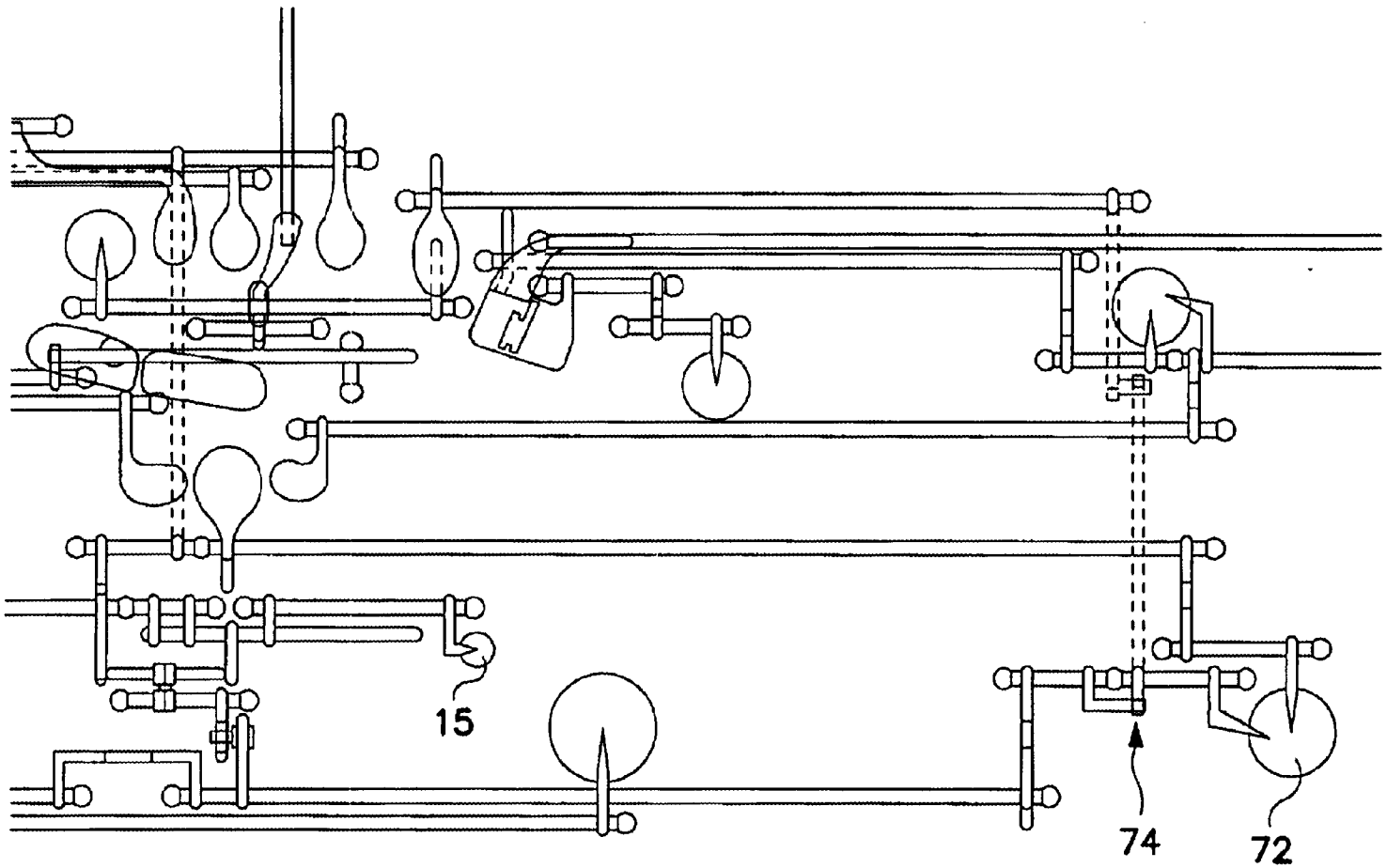
FIG. 7 shows key mechanisms associated with the low E key (943) of a contrabassoon constructed in accordance with the present invention.

FIG. 7 shows, in bold, the new linkage between lower vent key 70 and the 943 pad, indicated in FIG. 6 by reference numeral 72. The new linkage closes 943 (pad 72) by means of a clutch mechanism 74. Clutch mechanism 74 closes pad 72 any time lower vent touchpiece 70 is pressed, EXCEPT when RH3 is also pressed. In that case, pad 72 is open. Furthermore, even in the case when lower vent key 70 and RH3 are both pressed, the normal function of the low E key (pancake key) touchpiece for the right thumb is not interfered with, and it may still be used to close pad 72.

The function of this linkage is to provide stability for the notes G and G# (just above open F), which can now be played using lower vent key 70 in the fingering, providing clean and certain attacks at all dynamics.

Figure 8:
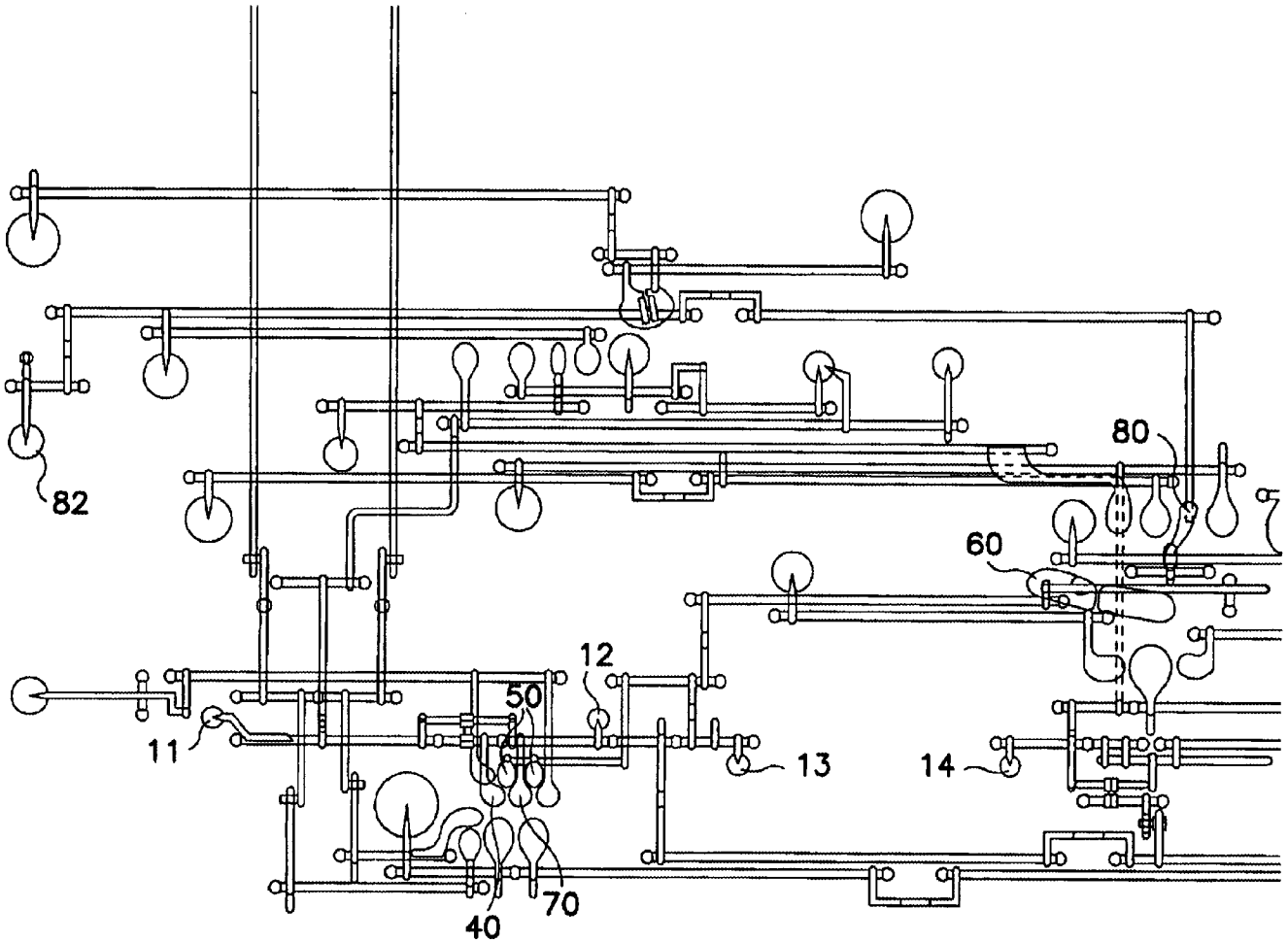
FIG. 8 shows key mechanisms associated with an alternate C# tone hole of a contrabassoon constructed in accordance with the present invention.

FIG. 8 shows, in bold, touchpiece 80 for the key hinged under the palm of the right hand, and pressed by RH2. This key activates a linkage up to a second C# tone hole 82 on the front side of the instrument. The second C# tone hole 82 is an option that some contrabassoon manufacturers provide, but the touchpiece for this alternate C# tone hole has always been activated by the left hand little finger. This imitates the C# played by LH4 commonly found on French bassoons. Activating this key by pressing RH2 is believed to be new to the contrabassoon, and works together with the new register key system to provide a logical fingering sequence.

C# key 80 facilitates ease of technique in many passages which would otherwise be cumbersome or awkward to play. It allows the player to eliminate many fingerings where the left thumb is required to press two keys at once (the C# key plus one of the register keys). This represents a significant advance over the traditional contrabassoon.

Many, if not most, contrabassoons have a tuning slide. Up until now, most manufacturers have left it up to the player to discover the proper relationship between the dimensions of the reed, the length of bocal, and the distance the tuning slide should be pulled to obtain the desired pitch level and the best intonation characteristics between notes of different octaves. A complicating factor for the contrabassoon is that the tuning slide lies between the tone holes on the wooden body of the instrument and most of the register holes (one of the register holes in the present invention is on the slide itself). This means that as one pulls the slide out to lower the overall pitch, the register holes effectively get moved up the bore. The effect of this is that it makes the upper register notes sharp in relation to the notes of the fundamental octave. Pushing the tuning slide in has the opposite effect. As the overall pitch of the instrument rises, the octave relationships get narrower, i.e., the upper notes get flatter in relation to the lower octave notes. Despite these characteristics, manufacturers have not traditionally supplied information to players about what might be the proper distance for the tuning slide to be pulled out for the optimum functioning of the register keys. In the end, this was not such a critical factor, as the system of register holes was so crude that this problem did not make itself readily apparent, among the myriad of other problems that existed.

The contrabassoon of the present invention provides players with this benchmark. The register key system is designed for optimum performance (clean, secure attacks at all dynamics and good intonation) with the tuning slide pulled out approximately one-half inch. This provides players an instrument with improved and consistent intonation characteristics, while also providing the ability to adjust pitch up or down by pushing in or pulling out the tuning slide when they must adjust the pitch level quickly and temporarily. However, the instructions which will accompany this instrument will advise the player to adjust the dimensions of their reeds and/or find the proper length bocal so that the instrument plays at a pitch level they desire (or need) with the tuning slide pulled out approximately one-half inch, as a standard setting. By doing this, proper intonation is readily attained, along with the optimal functioning of the register key system.

Taken all together, the features described and illustrated represent a level of sophistication of the contrabassoon never before achieved by any manufacturer. The contrabassoon of the present invention is an instrument which is capable of meeting the demands of modem orchestral, solo, and chamber music playing.

Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A contrabassoon, comprising:

a body;

a tuning slide coupled to the body;

a bocal pipe coupled to the tuning slide;

said body, tuning slide and bocal pipe forming a tube having a continuous bore extending therethrough; and a register system comprising 5 vent holes formed in the tube.

2. A contrabassoon of claim 1, further comprising a key mechanism for selectively opening and closing the vent holes.

3. The contrabassoon of claim 2, wherein a portion of said key mechanism is configured to selectively open a first and a second of said vent holes.

4. The contrabassoon of claim 3, wherein said portion of said key mechanism comprises a touchpiece configured for actuation by the left thumb.

5. The contrabassoon of claim 3, wherein a portion of said key mechanism is configured to selectively open a third one of said vent holes.

6. The contrabassoon of claim 5, wherein said portion of said key mechanism comprises at least two touchpieces configured for alternative actuation by the left thumb or the right trigger finger.

7. The contrabassoon of claim 2, wherein a portion of said key mechanism is configured to selectively open a fourth and a fifth of said vent holes.

8. The contrabassoon of claim 7, wherein said portion of said key mechanism comprises a touchpiece configured for actuation by the left thumb.

9. The contrabassoon of claim 7, wherein said portion of said key mechanism further comprises linkage configured to selectively operate a low E vent pad.

10. The contrabassoon of claim 9, wherein said linkage comprises a clutch mechanism.

11. A contrabassoon of claim 1, wherein at least one of said 5 vent holes is formed in the bocal pipe.

12. A contrabassoon of claim 11, wherein 4 of said 5 vent holes are formed in the bocal pipe.

13. A contrabassoon of claim 1, wherein at least one of said 5 vent holes is formed in the tuning slide.

14. The contrabassoon of claim 1, wherein one of said 5 vent holes is located approximately 1 inch from an end of the bore.

15. The contrabassoon of claim 14, wherein said one hole is approximately 0.083 inch in diameter.

16. The contrabassoon of claim 1, wherein one of said 5 holes is located approximately 9 and ⅛ inches from an end of the bore.

17. The contrabassoon of claim 16, wherein said one hole is approximately 0.099 inch in diameter.

18. The contrabassoon of claim 1, wherein one of said 5 vent holes is located approximately 12 and ⅛ inches from an end of the bore.

19. The contrabassoon of claim 18, wherein said one hole is approximately 0.110 inch in diameter.

20. The contrabassoon of claim 1, wherein one of said 5 vent holes is located approximately 17 and ½ inches from an end of the bore.

21. The contrabassoon of claim 20, wherein said one hole is approximately 0.110 inch in diameter.

22. The contrabassoon of claim 1, wherein one of said 5 vent holes is located approximately 22 and 15⁄16 inches from an end of the bore.

23. The contrabassoon of claim 22, wherein said one hole is approximately 0.126 inch in diameter.

24. The contrabassoon of claim 22, wherein said one hole is located in the tuning slide.

25. The contrabassoon of claim 24, wherein the distance from the end of the bore to said one hole will vary with the position of the tuning slide.

26. The contrabassoon of claim 1, further comprising an alternative C # tone hole, and a key mechanism for selectively opening and closing the C # tone hole, said mechanism comprising a touchpiece configured for actuation by a finger of the right hand.

27. The contrabassoon of claim 1, wherein the register system is designed for optimum performance with the tuning slide pulled out approximately ½ inch.

* * * * *